US005685020A

United States Patent [19]

Powell et al.

[11] Patent Number: 5,685,020

[45] Date of Patent: Nov. 11, 1997

[54] BICYCLE HELMET WITH CHIN GUARD AND EASY-ADJUST STRAP SYSTEM

[76] Inventors: William V. Powell; Elizabeth A. Powell, both of 12163 SW. Anton Dr., Tigard, Oreg. 97223

[21] Appl. No.: 694,560

[22] Filed: Aug. 9, 1996

[51] Int. Cl.[6] ..... A42B 3/08

[52] U.S. Cl. ..... 2/421; 2/425

[58] Field of Search ..... 2/410, 411, 421, 2/422, 425, 9

[56] References Cited

U.S. PATENT DOCUMENTS

| | | | |
|---|---|---|---|
| 2,846,683 | 8/1958 | Dye et al. | 2/421 |
| 3,166,761 | 1/1965 | Strohm | 2/421 |
| 3,187,342 | 6/1965 | Aileo | 2/421 |
| 3,311,921 | 4/1967 | Helm | 2/421 |
| 4,461,044 | 7/1984 | Reiterman et al. | 2/421 |
| 4,741,054 | 5/1988 | Mattes . | |
| 4,856,119 | 8/1989 | Haberle . | |
| 4,999,855 | 3/1991 | Brown . | |
| 5,023,958 | 6/1991 | Rotzin | 2/425 |
| 5,083,321 | 1/1992 | Davidsson | 2/421 |
| 5,179,735 | 1/1993 | Thomanek | 2/421 |
| 5,272,773 | 12/1993 | Kamata | 2/425 |
| 5,347,660 | 9/1994 | Zide et al. | 2/421 |

FOREIGN PATENT DOCUMENTS

| | | | |
|---|---|---|---|
| 2240255 | 7/1991 | United Kingdom | 2/421 |

*Primary Examiner*—Michael A. Neas
*Attorney, Agent, or Firm*—Dennis H. Lambert

[57] ABSTRACT

Protective headgear with adjustable strap system and chin guard includes a first strap secured at its opposite ends to opposite sides of the headgear and adapted to extend downwardly therefrom to beneath the jaw of a person wearing the headgear, and a second strap secured at its opposite ends to opposite rear portions of the headgear and adapted to extend forwardly to and in front of the chin of a person wearing the headgear. The first and second straps are connected with first and second coupling members, respectively, at opposite sides of the strap system, connecting the first and second straps together where they intersect. The coupling members are fixed relative to the first strap and are slidable along the second strap, and one of the coupling members includes a quick-disconnect fitting to enable the first strap to be disconnected between its ends to enable the helmet to be quickly and easily applied to and removed from the head of a person using the headgear. The second strap is adjustable in length, and the chin guard is slidably adjustable along the second strap to enable it to be accurately positioned after the length of the first and second straps are adjusted.

9 Claims, 4 Drawing Sheets

FIG.1.
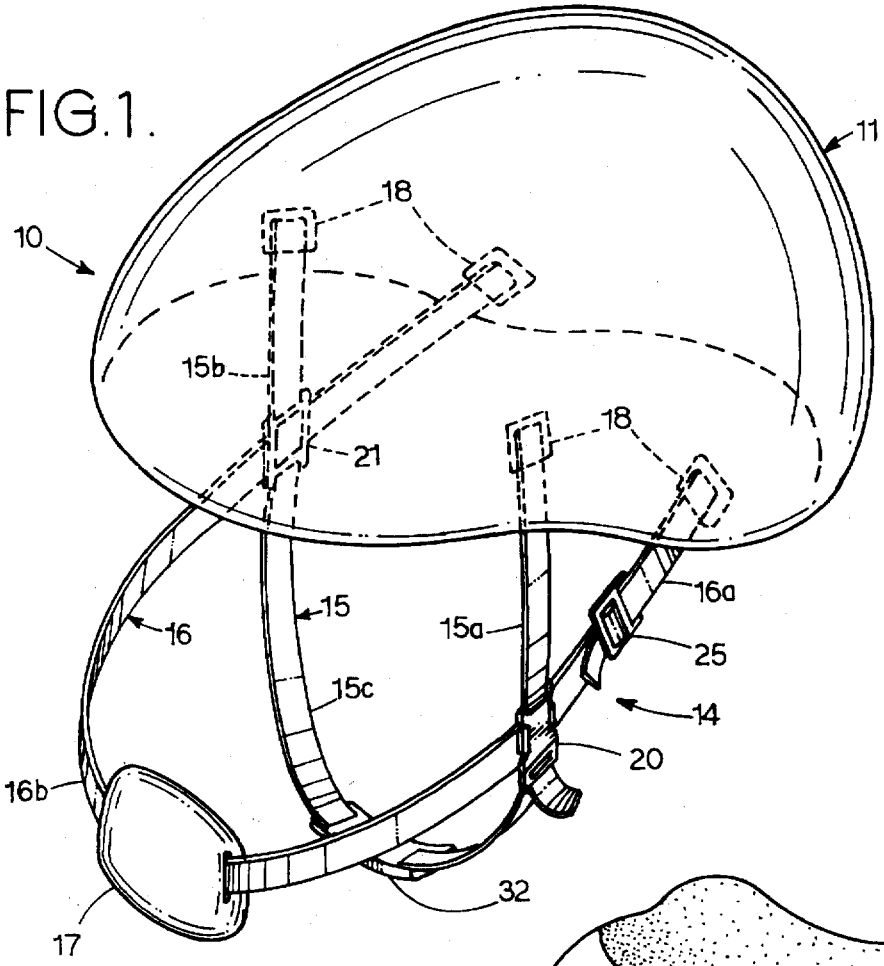
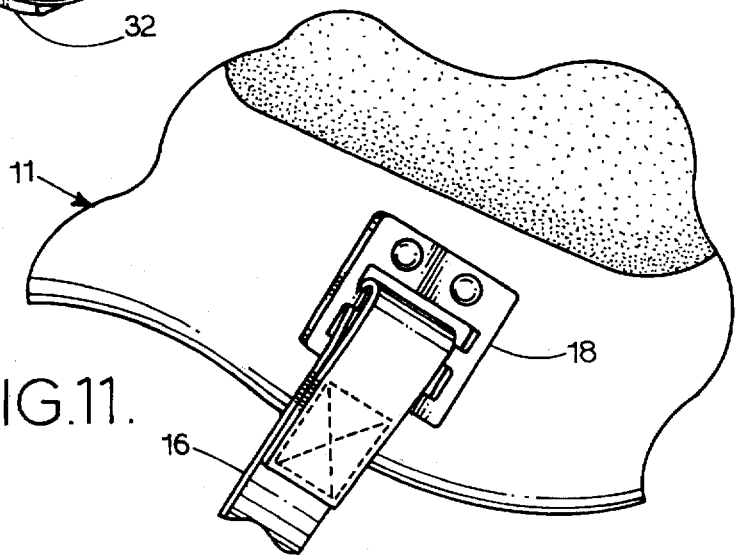
FIG.11.

FIG. 3.
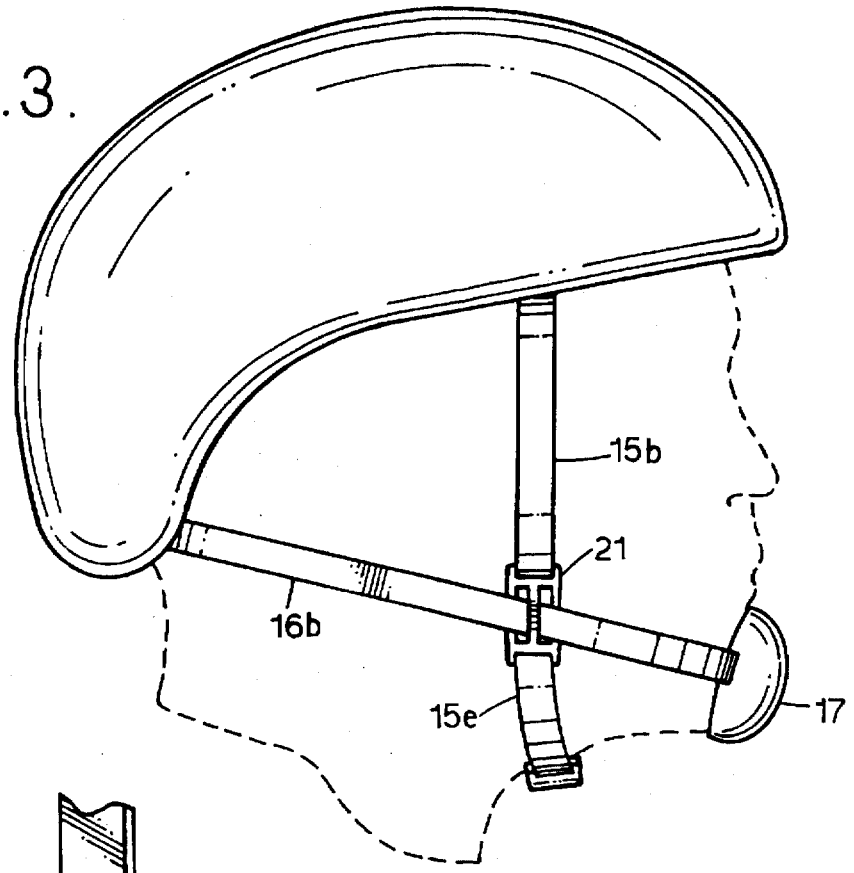
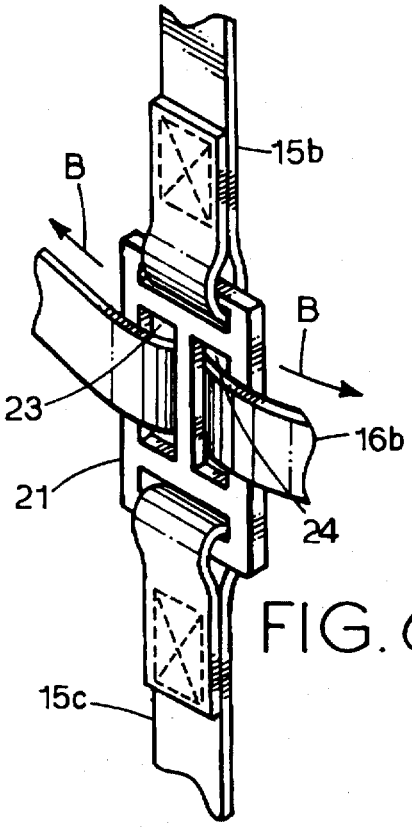
FIG. 6.
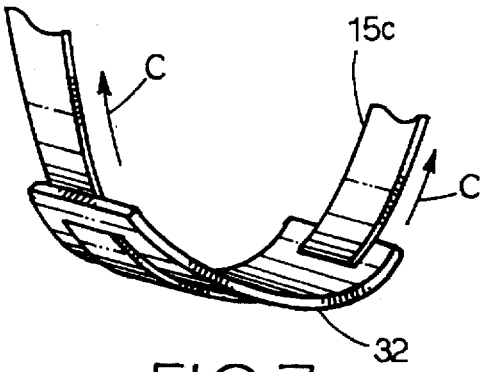
FIG. 7.

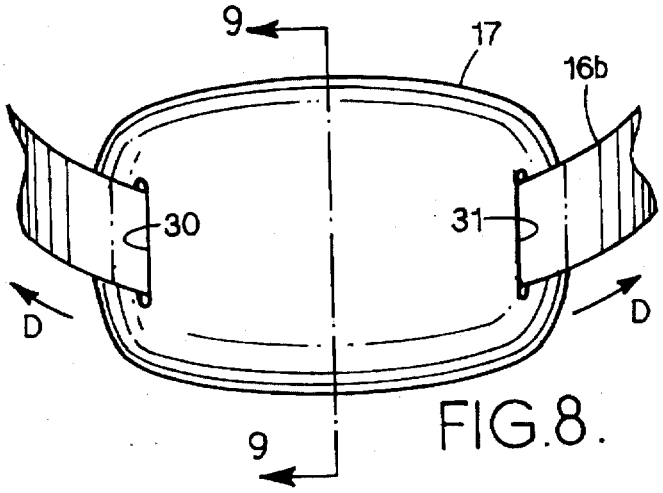
FIG.8.
FIG.9.
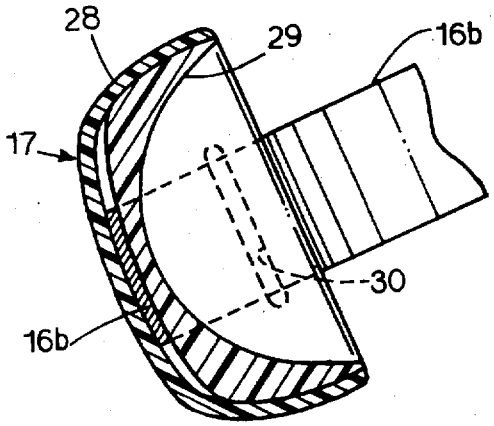
FIG.10.
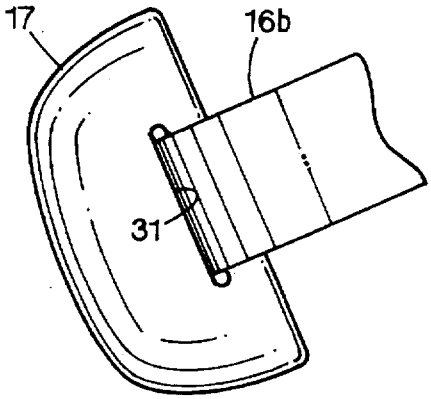

BICYCLE HELMET WITH CHIN GUARD AND EASY-ADJUST STRAP SYSTEM

BACKGROUND OF THE INVENTION

1. Field of the Invention

This invention relates generally to protective headgear, and more particularly, to a protective helmet to be worn in sports activities such as bicycling, roller blading, skate boarding, and the like.

2. Description of the Prior Art

Potential head injury is a hazard in many activities, both leisure and work related, and protective headgear has been devised in order to reduce the risk of head injury when engaged in such activities. In fact, specialized types of headgear have been developed for different activities, i.e., different types of helmet designs are made to meet the specific requirements of individual sports or other pursuits. Thus, one type of helmet may be used by football players, another type by baseball players, yet another type by hockey players, a still further type by motorcycle riders, and yet another type by bicycle riders, for example. Each of these individual helmet designs is intended to meet specific requirements related to the individual activity, and although the helmet designs do share some common features, they are distinct in their specific construction and function.

Although protective headgear is required by various laws and regulations to be worn in many activities, use of protective headgear is optional with the participant in many other activities. In either event, the headgear should not only afford the intended protection, but it should be comfortable to wear and easy to put on and take off. Moreover, the headgear should preferably include adjustments to enable it to be properly fitted to a wide range of head shapes and sizes.

Conventional helmet designs range from large and relatively heavy full face helmets, such as those worn by motorcyclists and race car drivers, to relatively lightweight structures intended to cover and protect only the skull of the user, such as those worn by bicyclists, for example.

Bicycle helmets, in particular, are typically relatively shallow helmet designs adapted to fit over the top of the wearer's head, and are secured in place by a chin strap extending downwardly alongside the wearer's face and beneath the jaw. Applicant is not aware of any prior bicycle helmet design which incorporates a chin guard to protect the wearer's chin in the event of a fall or spill.

Prior art helmet designs which do incorporate chin guards are exemplified in U.S. Pat. Nos. 4,741,054, 4,856,119 and 4,999,855. U.S. Pat. No. 4741054 is directed to a specific fastening system for securing the headgear to the wearer's head, and especially to a specific chin cup which is intended as a substitute for non-allergenic leather to protect against tissue reactions due to the skin sensitivities of various individuals. The chin cup in this patent is made of a dense, closed cell foam that is stamped into a desired shape and then formed into a cup-shaped contour. The chin cup is secured in fixed relationship to a pair of support straps extending from the chin cup to the headgear.

U.S. Pat. No. 4,856,119 does not disclose a chin protector, per se, but does disclose a cushion 20 on the chin strap 9, which is apparently intended to make the helmet more comfortable to wear by padding the chin strap where it passes beneath the jaw of the wearer.

U.S. Pat. No. 4,999,855 makes brief reference to the chin protector 56 (FIG. 3 and column 2, lines 31 and 32), but does not describe its construction or manner of attachment to the strap 58.

There is thus need for a lightweight helmet that incorporates a chin protector, and especially in which the support straps which hold the helmet in place are simple in construction and easy to apply and remove, and which includes adjustments for enabling the straps to be adjusted relative to one another and which enables the chin guard to be easily adjusted relative to its support strap, to enable the helmet to be quickly and easily adapted to the different sizes and shapes of the head and face of various individuals.

SUMMARY OF THE INVENTION

An object of the invention is to provide a helmet for protecting the head of the wearer during recreational and occupational activities, in which the helmet has a simple support strap arrangement that enables the helmet to be easily applied to and removed from the head of the wearer, and which includes a variety of adjustments to enable the helmet to be adapted to different shapes and sizes of the head and face of various individuals.

A more specific object of the invention is to provide a bicycle helmet which incorporates a chin guard for protecting the chin of the wearer, and wherein the straps for securing the helmet to the head of the wearer are simple in construction and easy to adjust, and wherein the chin guard is easily adjustable along its support strap, to enable the helmet and chin guard to be quickly and easily adjusted to different shapes and sizes of the head and face of various individuals.

These and other objects and advantages of the invention are accomplished in a bicycle helmet, in particular, in which the helmet has a rear portion that extends more deeply down the back of the wearer's head than a conventional bicycle helmet, and wherein a first support strap extends downwardly from opposite sides of the helmet to beneath the jaw of the wearer, and a second support strap extends from the rear portion of the helmet forwardly to a chin guard held in position on the chin of the wearer, with the first and second straps both including adjustments for adjusting their lengths, and the chin guard being slidably held on the second strap so that it may be moved along the second strap for optimum positioning relative to the chin of the wearer.

The first strap includes a quick-connect coupling to enable the helmet to be quickly and easily applied to and removed from the head of the wearer, and the first and second straps both include easily operated adjustments to enable their lengths to be adjusted to accommodate them to different individuals.

The helmet of the invention is simple and economical to make, is comfortable to wear, easy to adjust, and may be quickly and easily applied to the head of the wearer and removed therefrom.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein:

FIG. 1 is a top perspective view of a helmet incorporating the chin guard and adjustable strap system of the invention;

FIG. 3 is a right side view in elevation of the helmet of FIG. 1;

FIG. 6 is an enlarged, fragmentary, rear perspective view of the coupling means on the opposite side of the support strap system, showing how the first and second straps are interengaged for movement relative to one another;

FIG. 7 is a fragmentary, perspective view of a portion of the first strap and associated pad which extends beneath the jaw of the wearer;

FIG. 8 is an enlarged, fragmentary, front view in elevation of the chin guard used in the helmet of FIG. 1;

FIG. 9 is an enlarged, transverse, sectional view taken along line 9—9 in FIG. 8;

FIG. 10 is a fragmentary side view in elevation of the chin guard of FIG. 8; and FIG. 11 is an enlarged fragmentary sectional view in elevation of an inside portion of the helmet, showing one manner of attachment of the straps to the helmet.

DETAILED DESCRIPTION OF THE PREFERRED EMBODIMENTS

Figure 2:
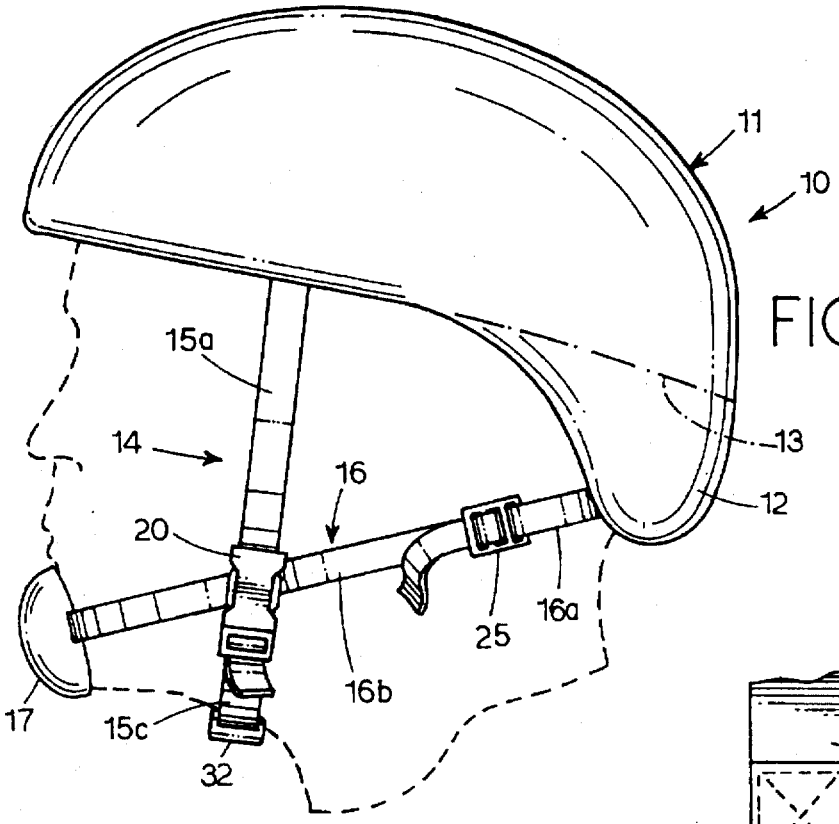
FIG. 2 is a left side view in elevation of the helmet of FIG. 1, showing it in place on the head of a wearer.
Figure 5:
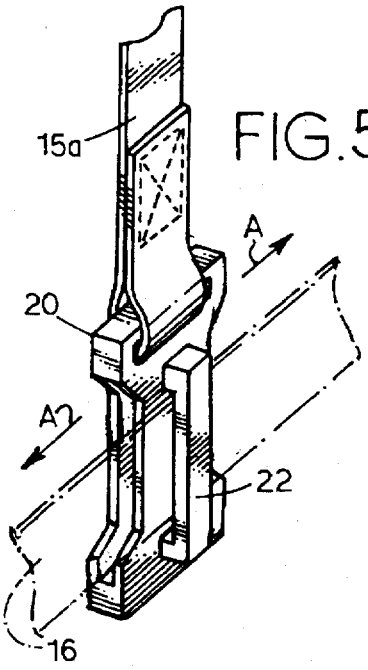
FIG. 5 is an enlarged, fragmentary, rear perspective view of the male member of the coupling shown in FIG. 4, illustrating the manner in which this coupling member is attached to and slidable with respect to the second strap.
Figure 4:
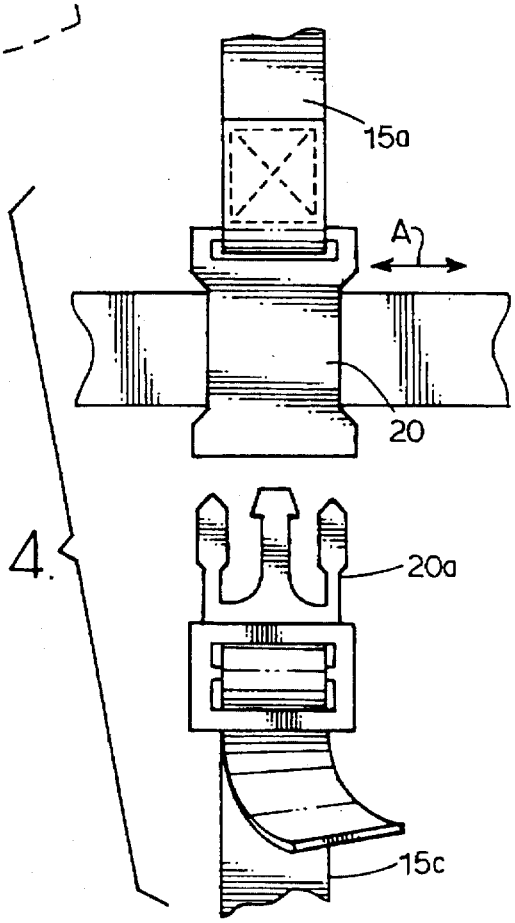
FIG. 4 is an enlarged, fragmentary, exploded view in elevation of the quick release coupling on the first strap, showing its adjustable relationship to the second strap.

Referring more specifically to the drawings, a bicycle helmet in accordance with the invention is indicated generally at 10 in FIGS. 1,2 and 3. The helmet 11 is of generally conventional construction and includes a hard, plastic outer shell with a high-density foam lining, meeting ANSI/SNELL requirements. This basic construction of the helmet itself, being conventional, will not be described herein in further detail, since reference can be made to conventional helmet constructions for the materials and techniques used in its construction. It should be noted, however, that the rear portion 12 of the helmet extends lower than a conventional bicycle helmet, which typically has a substantially straight bottom edge indicated by the dot-and-dash line 13 in FIG. 2.

With the exception of the deeper rear portion 12 of the helmet, the present invention resides essentially in the strap system 14 for securing the helmet to the head of the wearer. The strap system 14 includes a first strap 15 that is attached to and extends downwardly from opposite sides of the helmet and extends beneath the jaw of the wearer, and a second strap 16 that is attached to and extends forwardly from opposite sides of the rear portion 12 of the helmet to a chin guard 17 engaged over the chin of the wearer.

The ends of the straps 15 and 16 that are attached to the helmet 11 may be secured thereto in any suitable, conventional way. As shown in FIG. 11, these ends may be looped through a bracket 18 that is permanently attached to the helmet and then stitched or otherwise suitably fastened to permanently secure the strap to the helmet.

Strap 15 is comprised of three strap sections, 15*a*, 15*b* and 15*c*. Strap sections 15*a* and 15*b* each have one end permanently attached to the helmet 11, and their opposite free ends permanently attached to respective coupling members 20 and 21. Coupling member 20 comprises one half of a releasable coupling, for cooperation with a male coupling member 20*a* on one end of strap section 15*c* that can be quickly and easily connected to and released from the coupling member 20.

Strap section 15*c* has one end permanently attached to the coupling member 21, but the other end is adjustably connected with coupling member 20*a*, whereby the length of the strap 15 may be adjusted. It will be noted that both coupling members 20 and 21 are slidable along strap 16. To this end, strap 16 is threaded through a slotted bracket 22 on the rear of coupling member 20, and threaded through a pair of slots 23 and 24 in coupling member 21. Although specific constructions of coupling members have been illustrated and described, it should be understood that other constructions which perform the same function could be used.

Strap 16 comprises two strap sections, 16*a* and 16*b*, with one end of each permanently attached to the helmet by suitable means such as the brackets 18. A suitable coupling means 25 is attached to one end of the relatively short strap section 16*a*, and the free end of strap section 16*b* is adjustably engaged with this coupling means 25, which may comprise a pair of D-rings such as those used on motorcycle helmets, for example. As noted previously, the strap section 16*b* is slidably received through the coupling member 21 and coupling member 20, so that the straps 15 and 16 may be easily adjusted relative to one another simply by sliding the coupling members along the strap 16.

The chin guard 17 is constructed of similar materials to those used in the construction of the helmet 11, and includes a hard plastic outer shell 28 with a high density foam lining 29. A pair of slots 30 and 31 are formed in the outer shell 28 at opposite sides of the chin guard 17, and the strap section 16*b* is threaded through the slots and between the shell and the foam lining. The chin guard is slidable along the strap so that its position may be accurately located after adjustment of the length of the strap 16.

A pad 32 is slidably positioned on strap section 15*c* to enhance the comfort of wearing the strap.

It will thus be seen that only a single releasable connection is necessary in order to release the strap system to enable the helmet to be applied and removed from the head of the wearer, and every element of the strap system is easily and quickly adjustable to optimize the fit of the strap system to the different shape and size of the head and face of various individuals. In this regard, it should be noted that the easily adjustable position of the chin guard 17 is especially important, since upon adjustment of the lengths of the straps 15 and 16, the chin guard might otherwise be inappropriately positioned for contact with the chin of the wearer. With the present invention, however, after the lengths of the straps 15 and 16 are adjusted, the chin strap can also be quickly and easily repositioned, as necessary.

The straps may be made of any suitable material, including leather or nylon, and the couplings used to join the straps may be made of metal or plastic or other suitable material, and may have other constructions rather than those specifically described and illustrated herein, so long as they perform comparable functions.

While particular embodiments of the invention have been illustrated and described in detail herein, it should be understood that various changes and modifications may be made to the invention without departing from the spirit and intent of the invention as defined by the scope of the appended claims.

What is claimed is:

1. In combination, a bicycle helmet and chin guard for protecting the head and chin of a bicyclist in the event of a fall, wherein:

the helmet and chin guard are secured in place during use by a strap system that includes a first strap that is attached at its opposite ends to opposite sides of the helmet and is adapted to extend downwardly therefrom to beneath the jaw of a person wearing the helmet, and a second strap that is attached at its opposite ends to a rear portion of the helmet and includes a front portion that is adapted to extend across the front of the chin of a person wearing the helmet, said first and second straps intersecting one another at positions adapted to lie alongside opposite sides of the face of a person wearing the helmet;

said chin guard is mounted on the front portion of the second strap and is adjustable along said strap; and said first and second straps are adjustable in length, and coupling means connects them together where they intersect one another, said coupling means enabling the point of intersection of the first strap with the second strap to be adjusted along the length of the second strap.

2. A combination as claimed in claim 1, wherein:

said chin guard is slidably mounted on said second strap for adjustable sliding movement there along.

3. A combination as claimed in claim 2, wherein:

said coupling means includes first and second coupling means at opposite sides, respectively, of said helmet, one of said coupling means being fixed to said first strap and slidable along said second strap, and the other of said coupling means includes a disconnect fitting to enable said first strap to be disconnected between its ends for applying and removing the helmet with respect to the head of a person using the helmet.

4. A combination as claimed in claim 3, wherein:

said other of said coupling means is adjustably slidable along said second strap.

5. In combination, a helmet and chin guard for protecting the head and chin of a person wearing the helmet in the event of a fall, wherein:

the helmet and chin guard are secured in place during use by a strap system that includes a first strap that is attached at its opposite ends to opposite sides of the helmet and is adapted to extend downwardly therefrom to beneath the jaw of a person wearing the helmet, and a second strap that is attached at its opposite ends to a rear portion of the helmet and includes a front portion that is adapted to extend across the front of the chin of a person wearing the helmet, said first and second straps intersecting one another at positions adapted to lie alongside opposite sides of the face of a person wearing the helmet;

said chin guard is mounted on the front portion of the second strap and is adjustable along said strap; and said first and second straps are adjustable in length, and coupling means connects them together where they intersect one another, said coupling means enabling the point of intersection of the first strap with the second strap to be adjusted along the length of the second strap.

6. A combination as claimed in claim 5, wherein:

said chin guard is slidably mounted on said second strap for adjustable sliding movement there along.

7. A combination as claimed in claim 6, wherein:

said coupling means includes first and second coupling means at opposite sides, respectively, of said helmet, one of said coupling means being fixed to said first strap and slidable along said second strap, and the other of said coupling means includes a disconnect fitting to enable said first strap to be disconnected between its ends for applying and removing the helmet with respect to the head of a person using the helmet.

8. A combination as claimed in claim 7, wherein:

said other of said coupling means is adjustably slidable along said second strap.

9. A strap system for securing protective headgear to the head of a person using the headgear, comprising:

a first strap having opposite ends adapted to be secured to opposite sides of headgear, and a midportion adapted to extend beneath the jaw of a person wearing the headgear;

a second strap having opposite ends adapted to be secured to opposite sides of a rear portion of headgear, and a midportion adapted to extend in front of the chin of a person wearing the headgear;

a chin guard adjustably mounted on the midportion of said second strap for adjustable positioning along the length of said second strap;

said first strap including first, second and third strap sections with said first and second strap sections each having one end adapted to be secured to respective opposite sides of a headgear and a second end secured to respective first and second coupling members, and the third strap section having one end fixed to one of the coupling members and a second end connected to a fitting that is releasably connected to the other coupling member, said third strap section being adapted to extend beneath the jaw of a person when the strap system is in use;

said coupling members being slidably mounted on said second strap for adjustable positioning along the length of the second strap; and said second strap including first and second strap sections, each having one end adapted to be fixed to a respective opposite rear side portion of headgear, and opposite adjoining ends adjustably interconnected to one another so that the length of the second strap may be adjusted.

* * * * *